US005222284A

United States Patent [19]

Maddock

[11] Patent Number: 5,222,284

[45] Date of Patent: Jun. 29, 1993

[54] APPARATUS FOR MAKING CO-AXIAL CABLE

[75] Inventor: Brian Maddock, Dorset, Great Britain

[73] Assignee: Halton Machinery Ltd., Dorset, United Kingdom

[21] Appl. No.: 817,658

[22] Filed: Jan. 7, 1992

[30] Foreign Application Priority Data

Jan. 8, 1991 [GB] United Kingdom ..... 9100317

[51] Int. Cl.[5] ..... H01B 13/00

[52] U.S. Cl. ..... 29/33 F; 29/728; 72/52; 72/258; 156/428

[58] Field of Search ..... 29/33 E, 33 F, 33 Q, 29/33 T, 527.3, 33 D, 745, 820, 728, 828; 72/46, 47, 52, 256, 187, 258; 156/428

[56] References Cited

U.S. PATENT DOCUMENTS 2,765,527 10/1956 Fairfield et al. ..... 29/33 F X
3,899,824 8/1975 Beach ..... 72/187 X
4,473,936 10/1984 Kellner ..... 29/33 K X
4,984,357 1/1991 Pan ..... 29/728 X
5,018,268 5/1991 Chabane et al. ..... 29/728

FOREIGN PATENT DOCUMENTS 2-213002 8/1990 Japan ..... 29/33 F

*Primary Examiner*—William Briggs
*Attorney, Agent, or Firm*—Fay, Sharpe, Beall, Fagan, Minnich & McKee

[57] ABSTRACT

Conventionally co-axial cable is made in a continuous extrusion machine by continuously extruding an aluminium tubular cladding (1) through an annular die and simultaneously continuously introducing a core (4), comprised of a conductive wire surrounded by insulation, through an bore in a mandrel (3). A gap is inevitably present between the outer surface of the core (4) and the tubular cladding (1). To eliminate the gap it is necessary to reduce the diameter of the tubular cladding by swagging or drawing step by compacting the insulation of the core before introduction to the mandrel (3). The insulation then gradually expands to recover its original diameter and fill the cladding which has been extruded to its final diameter.

12 Claims, 1 Drawing Sheet

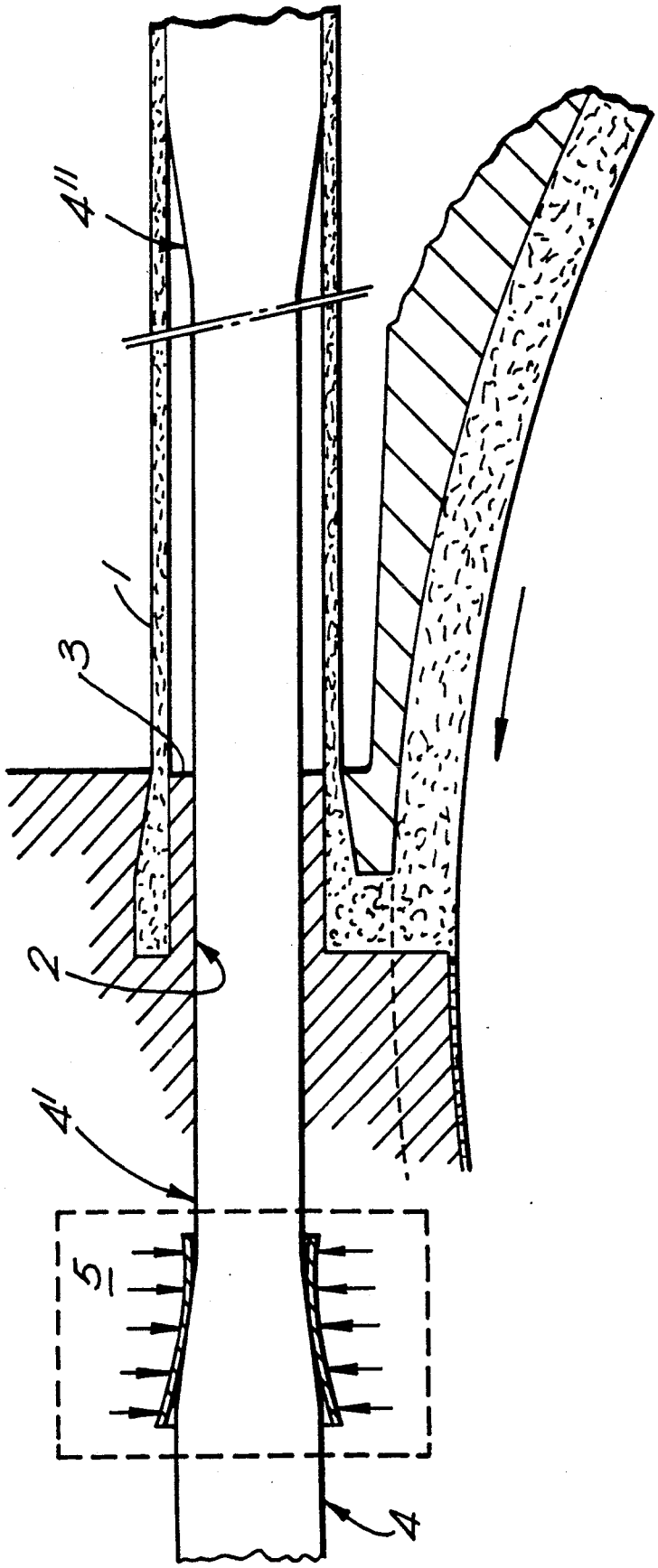
4''
1
3
2
4'
5
4

APPARATUS FOR MAKING CO-AXIAL CABLE

The present invention concerns a process for the manufacture of co-axial conductive cable, an apparatus for the process and an improved co-axial cable produced by the process.

Conventionally, co-axial cable can be produced in a continuous extrusion machine sometimes known as a 'Conform' extrusion machine. This type of machine comprises a rotatably mounted wheel having an endless circumferential groove. A shoe is adapted to close part of the groove and mounts tooling which includes; an abutment arranged to at least partially block the groove and a passage leading to a die structure. Aluminium or other metal stock introduced into the groove is heated and pressurized by friction. The material engages the abutment in a condition in which it flows through the passage and is extruded through the die structure.

To produce co-axial cable the aluminium is extruded as a tube through an annular die structure formed of an outer die part and a co-axial mandrel. An aperture is formed in the mandrel through which a core comprising a conductive wire coated in insulating material is passed. An annular space is formed between the core and the tube. To eliminate the space so that the core is tightly clad in a tubular sheath it is necessary to follow the extrusion stage by a step in which the tube is drawn or swagged as described in the specification of EP 0 125 788.

To exemplify the problem experienced with the prior art method, it has been found that a cylindrical mandrel made of tungsten carbide or H13 tool steel must have an outside diameter of at least 40% greater than the diameter of the aperture. Consequently to produce co-axial cable with a 12 mm core diameter the tube extruded must have an inside diameter of at least 15 mm. Subsequent to the extrusion step the tube must then be swagged or drawn down to an inside diameter of 12 mm. This is inconvenient because of the apparatus required for the drawing or swagging step, the energy the step consumes and because the step work-hardens the cladding making the cable difficult to manipulate.

It is an object of the present invention to provide a process and apparatus for the production of co-axial cable which alleviates the aforementioned problems.

According to the present invention there is provided a process for the production of co-axial cable comprising the steps of: continuously compacting an elongate core consisting of a conductor coated with an insulator to reduce the cross-section of the core, continuously extruding a tubular metal cladding, and simultaneously continuously feeding the compacted core into the cladding whereby the compacted core recovers towards its original cross section to fill the cladding.

According to a second aspect of the present invention there is provided apparatus for the production of co-axial cable comprising: a continuous extrusion machine provided with a die structure for extruding tubular metal cladding, said die structure having means for the continuous introduction of an elongate core into the cladding as the cladding is extruded, and compacting means provides upstream of the die structure to continuously compact an insulating coating surrounding an elongate conductor in the core, to reduce the cross section of the core from a cross section at least equal to the cross section inside the tube to a cross section less than that inside the tube.

It will be appreciated that the present invention depends on the discovery that cellular plastic insulating material can be compacted to reduce the cross-section (e.g., the diameter) of the core by the application of a compressive force in substantially the radial direction and, when the compressive force is relieved, the insulting material gradually recovers so the cross-section of the core tends to return to the original dimensions. Because the cross section of the core is temporarily reduced it can be fed through a mandrel dimensioned to extrude the tubular cladding to the finished dimensions required for the cable. The compacted core then expands to engage the inner surfaces of the tubular cladding so that the swagging or drawing step required in conventional methods and the apparatus for the swagging or drawing step is not required. Because the cladding is not swagged or drawn it is not work hardened and the co-axial cable produced is therefore advantageously more flexible.

Recovery of the insulating material is not instantaneous. It has been found that the rate of recovery is temperature dependent and in consequence temperature control means may be installed to control temperature of the core and hence control the rate of recovery. This may include heating means upstream of the die to increase the rate of recovery.

In an example of the process according to the present invention as illustrated in the figure, a die structure is provided in a continuous extrusion machine to extrude metal tubing 1 with an inside diameter of 12 mm. An aperture 2 is formed co-axially in a mandrel 3 of the die structure and has a diameter less than or equal to about 60% of the outside diameter of the core so that in this case the aperture is approximately 8.5 mm in diameter. An elongate 12 mm diameter core 4 comprising a conductor surrounded by a cellular plastic insulating material is fed to means (5) in which the insulating material is compressed radially inwardly to compact it to a diameter not greater than 8.5 mm. The compacting device (5) may take the form of a conical drawing die having a polished bore through which the core is drawn to compress the insulating material. The compacted core 4 is then fed through the mandrel aperture 2 into the tube 1 as it is being extruded. The core 4 is allowed to recover so that the spongy insulating material expands to fill the tubular cladding 1. The insulating material may be cellular polythene and the tubular cladding may be extruded aluminium having a proof stress of 50–60 $N/mm^2$.

I claim:

1. Apparatus for the production of co-axial cable comprising:

a continuous extrusion machine provided with a die structure for extruding tubular metal cladding, said die structure having means for the continuous introduction of an elongate core into the cladding as the cladding is extruded, and compacting means provided upstream of the die structure to continuously compact an insulating coating surrounding an elongate conductor of the core, to reduce the cross section of the core from a cross section at least equal to the cross section inside the tube to a cross section less than that inside the tube.

2. Apparatus according to claim 1 wherein the compacting means comprises a conical drawing die.

3. Apparatus according to claim 1 wherein a temperature control means is provided to control the temperature of the core to recover at a desired rate.

4. Apparatus according to claim 2 wherein a temperature control means is provided to control the temperature of the core to recover at a desired rate.

5. An apparatus for the production of co-axial cable, comprising:

a means for continuously compacting an elongate core to reduce the cross-section thereof;

a means for continuously extruding a tubular cladding; and, a means for feeding the compacted elongate core into said tubular cladding, wherein the compacted elongate core recovers toward its original cross-section to fill said tubular cladding.

6. The apparatus of claim 5 wherein said elongate core comprises a conductor and an insulator coating said conductor and wherein said tubular cladding comprises a metal material.

7. The apparatus of claim 5 wherein said means for continuously compacting comprises a conical drawing die.

8. The apparatus of claim 5 wherein said means for continuously extruding comprises a continuous extrusion machine.

9. The apparatus of claim 8 wherein said means for feeding comprises a mandrel of a die structure of said continuous extrusion machine.

10. The apparatus of claim 5 further comprising a temperature control means for controlling a temperature of said elongate core.

11. The apparatus of claim 10 wherein said means for controlling a temperature comprises a heater.

12. The apparatus of claim 11 wherein said heater is located upstream of said means for feeding.

* * * * *

UNITED STATES PATENT AND TRADEMARK OFFICE

CERTIFICATE OF CORRECTION

PATENT NO. : 5,222,284

DATED : June 29, 1993

INVENTOR(S) : Brian Maddock

It is certified that error appears in the above-identified patent and that said Letters Patent is hereby corrected as shown below:

On title page, Assignee field (73), delete "Halton Machinery Ltd.", and insert therefor ---Holton Machinery Ltd.---

Signed and Sealed this

Twenty-sixth Day of July, 1994

Bruce Lehman

*Attest:*

BRUCE LEHMAN

*Attesting Officer*

*Commissioner of Patents and Trademarks*